US006783616B1

(12) United States Patent
Krone et al.

(10) Patent No.: US 6,783,616 B1
(45) Date of Patent: Aug. 31, 2004

(54) METHOD TO PRODUCE PYROTECHNICAL IGNITING MIXTURES

(75) Inventors: Uwe Krone, Hamfelde (DE); Dirk Cegiel, Stubben (DE)

(73) Assignee: Nico-Pyrotechnik Hanns Juergen Diederichs GmbH & Co. KG, Trittau (DE)

( * ) Notice: Subject to any disclaimer, the term of this patent is extended or adjusted under 35 U.S.C. 154(b) by 0 days.

(21) Appl. No.: 09/701,275

(22) PCT Filed: Apr. 16, 1999

(86) PCT No.: PCT/DE99/01160

§ 371 (c)(1),
(2), (4) Date: Nov. 28, 2000

(87) PCT Pub. No.: WO99/61394

PCT Pub. Date: Dec. 2, 1999

(30) Foreign Application Priority Data

May 28, 1998 (DE) ..... 198 23 999

(51) Int. Cl.[7] ..... C06B 45/10; C06B 29/02; D03D 23/00

(52) U.S. Cl. ..... 149/19.92; 149/19.3; 149/42; 149/77; 149/108.6; 149/109.6

(58) Field of Search ..... 149/19.92, 19.3, 149/77, 108.6, 109.6, 42

(56) References Cited

U.S. PATENT DOCUMENTS

| | | | | | |
|---|---|---|---|---|---|
| 3,222,231 | A | | 12/1965 | Markels et al. | 149/2 |
| 3,420,137 | A | | 1/1969 | Staba et al. | 86/1 |
| 3,652,350 | A | | 3/1972 | Timmermans | 149/109 |
| 3,708,357 | A | * | 1/1973 | Morrow | 149/77 |
| 3,739,166 | A | * | 6/1973 | Anderson | 362/5 |
| 3,954,526 | A | * | 5/1976 | Mangum et al. | 149/7 |
| 4,000,025 | A | * | 12/1976 | Johnson et al. | 149/19.92 |
| 4,207,125 | A | * | 6/1980 | Grant | 149/109.6 |
| 4,247,494 | A | * | 1/1981 | Carter | 264/3.1 |
| 4,287,010 | A | * | 9/1981 | Owen, II | 149/109.6 |
| 4,428,786 | A | * | 1/1984 | Arni | 149/109.6 |
| 4,640,724 | A | * | 2/1987 | Carter et al. | 149/109.6 |
| 4,841,856 | A | * | 6/1989 | Gisler et al. | 102/202.13 |
| 4,841,865 | A | * | 6/1989 | Liberman | 149/109.6 |
| 5,731,540 | A | * | 3/1998 | Flanigan et al. | 149/109.6 |
| 5,732,634 | A | * | 3/1998 | Flickinger et al. | 102/202.7 |
| 5,763,814 | A | * | 6/1998 | Avory et al. | 102/202.7 |
| 5,831,207 | A | * | 11/1998 | Seeger et al. | 149/18 |
| 6,170,399 | B1 | * | 1/2001 | Nielson et al. | 102/336 |
| 6,224,099 | B1 | * | 5/2001 | Nielson et al. | 280/741 |

FOREIGN PATENT DOCUMENTS

| | | |
|---|---|---|
| CH | 664554 | 3/1988 |
| DE | 2712603 | 9/1977 |
| DE | 3925234 | 1/1991 |
| EP | 0745574 | 12/1996 |
| RU | 2050963 | 12/1995 |
| RU | 2056926 | 3/1996 |

OTHER PUBLICATIONS

Spektrum Der Wissenschaft, K.S. Suslick, Edition 4, pp. 60ff, 1989.

* cited by examiner

*Primary Examiner*—Aileen B. Felton
(74) *Attorney, Agent, or Firm*—Milde & Hoffberg, LLP

(57) ABSTRACT

The invention relates to pyrotechnic primer charges produced on the basis of metal powders or metal hydride powders, potassium perchlorate and binders. In order to obtain a homogenous mixture, the powdery components are mixed with a liquid dispersing agent in a suspension with the aid of ultrasound and dosed having said consistency. Mixing for obtaining a suspension can also be carried out directly in a casing receiving the pyrotechnic primer charges.

26 Claims, No Drawings

METHOD TO PRODUCE PYROTECHNICAL IGNITING MIXTURES

BACKGROUND OF THE INVENTION

The invention relates to a method for producing pyrotechnical igniting mixtures on the basis of metal powders or metal hydrides, potassium perchlorate and binding agents.

Pyrotechnical igniting mixtures are mixtures of solid matter in mostly the powdery state whose components consist mainly of reducing agents and oxidizing agents. When a sufficient quantity of energy is supplied, e.g. in form of an igniting flame, an oxidation-reduction process is initiated: the pyrotechnical mixture will burn away more or less intensely depending on make-up and arrangement.

Pyrotechnical igniting mixtures have numerous uses and are used, for example, as igniting heads of matchsticks, in flare and signal ammunition, in smoke and cloud bodies, in gas generators, e.g. for safety airbags, and in numerous other arrangements in fireworks bodies.

Pyrotechnical igniting mixtures are usually produced by dry mixing of the individual components. If this is performed by hand, the comminuted components are pressed through screens and mixed thoroughly. In the case of mixing by machines, the components of the pyrotechnical mixture are filled in the unmixed state into the receptacle, with optional prior comminution, and mixed in the same by stirrers, rotational movements of the mixing receptacle or devices that apply shearing forces. Suitable mixing devices are asymmetric moved mixers, tetrahedral mixers, planetary mixers or mixing apparatuses derived from or combined with the same.

Pyrotechnical igniting mixtures are often used as granulate, because they can be better poured and apportioned in this form. Granulation is performed by adding a suitable solvent to the dry igniting mixture and mixing in special receptacles. In this process the solvent can already be contained in the binding agent in dissolved form, or the binding agent component which is swellable with the solvent or is soluble in the same is already located in powder form in the pyrotechnical mixture, so that on adding the solvent adhesive forces are able to form which finally lead to the granulate form. Special granulate mixers are provided for the formation of the granulate form. The solvent is removed again by subsequent drying, so that a pourable material is obtained that can be apportioned.

When the components of the pyrotechnical igniting mixture are very fine or the energy stored in the same is very high, measures must be taken in order to keep the hazards manageable during production. The mechanical and thermal sensitivity of these igniting mixtures is often so strong, that handling the same without suitable safety measures is not advisable.

Numerous safety regulations take into account the hazardousness during production. Accordingly, pyrotechnical mixtures are listed according to groups of hazardousness in the accident prevention regulations as issued by the social insurance institutions against occupational accidents. The regulations demand graded safety precautions in the production of the mixtures. The two most hazardous groups may no longer be mixed by hand. They are mixed automatically behind protective walls or in a separated room which is closed off from the control room by a resisting wall. This type of production is usually called "working under security". This applies primarily for dry powdery components.

If measures are taken during the mixing which reduce the ignitability and the mechanical or thermal sensitivity of the mixtures, reductions in the grading can be made for the above breakdown into groups. One such measure is mixing the components not in the dry state, but together with a liquid.

This method is used particularly during the mixture of pyrotechnical igniting mixtures. By adding solvents such as water, pyrotechnical igniting mixtures can be produced with considerably fewer hazards than in the dry state. The energy stored in the igniting mixtures is still so high, however, that the effects of an ignition caused by an accident prevent the processing by hand even in the wet state. Moreover, the mass of the mixture quantity must be kept low (usually under 100 grams), so that any ignition even during production remains securely manageable.

A further difficulty in this method is the dimensioning of the quantity of the liquid. On the one hand it must be large enough to clearly reduce the hazard of an ignition while mixing the pyrotechnical mixture. On the other hand, any increase in the quantity of liquid also increases the subsequent duration of drying. Moreover, the danger of cracking and shrinkage cavitation increases during drying. Cracks and shrinkage endanger the secure function of the igniting mixture during its ignition.

Since the liquid is included in the mixture which is subsequently dosed in the igniter during the production of the pyrotechnical igniting mixture, but is not involved in the actual conversion of the igniting mixture, the liquid content of the mixture must be precisely definable and must also be kept constant during the dosing. Only in such cases will the igniting mixtures have the same properties during the subsequent drying.

It is further known that liquid paste-like mixtures for pyrotechnical igniting mixtures with components of different density, solubility or electric environment, e.g. the formation of dipoles or charging in the same or opposite direction, are relatively difficult to handle. In the mixtures the various solid components have different sedimentation speeds, so that after a short dwell time the liquid and the solids separate and make the reproducible dosing of the mixture more difficult, which again impairs the quality of the igniter.

SUMMARY OF THE INVENTION

The invention is based on the object of providing a method to produce pyrotechnical igniting mixtures of the kind mentioned above with which the employed components can be mixed homogeneously, the hazard of an ignition can simultaneously be reduced considerably and a reproducible dosing is enabled.

This object, as well as other objects which will become apparent from the discussion that follows, are achieved, in accordance with the present invention, by producing suspensions from the individual components of the pyrotechnical igniting mixture with the help of liquid dispersing agents, with the suspensions, which are not explosive or only marginally so, being mixed by using ultrasonic sound; immediately after the mixing dosing the mixture in this consistency in the desired quantity; and thereafter removing the dispersing agent from the dosed quantity.

Accordingly, several homogenous suspensions are produced from the individual components for the pyrotechnical igniting mixture with the help of suitable liquid dispersing agents, with these suspensions not being explosive or only marginally so. The suspensions are mixed in small quantities with the help of ultrasonic sound. The mixture is dosed in this consistency immediately thereafter for the igniter in the respective, desired quantity; e.g., in igniters or on igniting elements, whereupon the dispersing agents are removed from the dosed quantity.

The application of ultrasonic sound on liquid mixtures made of several components is known, for example from the German Patent Publication No. DE-A1-27 12 603 which discloses a method and an apparatus for modifying the characteristics of a liquid with the several components of the liquid being homogenized by means of ultrasound while flowing through a pipe. It is also known from Soviet patent applications 2050963 and 2056926 to use ultrasonic dispersing mixers in order to thoroughly mix different components, particularly in the foodstuff area. The homogenization or mixing is performed in all these mixing methods in a continuous manner. A respective dosing or drying of the dosed mixture is not provided. Moreover, these methods do not consider any safety measures which need be considered in the mixture of pyrotechnical igniting mixtures.

In accordance with the invention the suspensions which are not explosive, or only marginally so, are mixed in small quantities in batches and dosed immediately after said mixing, e.g. in the housing of an airbag igniter. In this way, an absolutely homogenous distribution of the components is achieved which is maintained even during the removal of the dispersing agent from the liquid mixture, so that the formation of cracks and shrinkages are avoided and the igniting properties of the igniter are reproducible.

The grain sizes of the employed solids, i.e. metal powder or metal hydrides and the potassium perchlorate, are preferably smaller than 50 $\mu$m, or smaller than 20 $\mu$m.

In accordance with the invention, a suitable quantity of dispersing agent achieves both an optimal mixture of the components as well as a suitable viscosity of the suspension for the subsequent dosing. The energy required for the homogenous distribution of the components in the suspension is introduced into the mixture by cavitation. The cavitation is produced by ultrasonic sound with frequencies preferably higher than 16 kHz. During the implosion of the gas bubbles produced by the cavitation temperatures of approx. 5500° C. and pressures up to 500 bar can be reached. As a result of the speed of the disintegration of the gas bubbles in a time interval of less than 1 $\mu$s and by the small magnitude of the gas bubbles which are usually smaller than 150 $\mu$m, the cooling speed during the implosion is so high that the heating of the suspension remains negligible. The chemical effects of ultrasonic sound have already been described by K. S. Suslick in the publication "Spektrum der Wissenschaft", Edition 4, pages 60ff, 1989, where essentially aspects of the sono-chemistry of liquids and solid surfaces as well as of suspended particles were examined.

It is a further feature of the invention that the components are mixed directly in the receptacle from which the dosing is made immediately after the production of the dispersion. This is easily possible by using respectively shaped sonotrodes. The mixtures are produced in cartridges which are thereafter inserted into a dosing apparatus. The liquid mixtures are then dosed with slight pressure or by vacuum into prepared igniter housings or on igniter elements.

In order to prevent sedimentations or coagulation effects in the course of the dosing process, the cartridges which contain the igniting mixture can be subjected to mechanical oscillations or sound waves.

Filling and re-filling processes after the mixing are avoided by performing the mixing directly in the dosing receptacle. Such processes could lead to incrustations or desiccated material on the walls, which should be avoided under all circumstances due to the explosive character of the mixture.

The avoidance of the hazards which may occur during the mixing of larger quantities is the mixing as provided for by the invention in a relatively small mixing space of components of the igniting mixture which are mixed preliminarily in suspension and which are not explosive or marginally explosive and the subsequent filling or dosing therefrom into an igniter shell. The mixing space can be provided in this process with a sonotrode connection or a mechanical sonotrode contact.

In accordance with the invention, preferably only as much of this actually hazardous mixture is produced as is required for a single or a few igniters. The production can then be controlled mechanically in a more economic manner at a cycle speed which is high enough for series production. If a composition of the igniting mixture is chosen of potassium perchlorate, zirconium powder, a binding agent and a solvent, two suspension-like pre-mixes can be produced which are not or only marginally explosive, namely as the one component the potassium perchlorate dispersed in the solvent and as the second component the zirconium powder dispersed in the solvent, with the binding agent already being dissolved in the solvent.

In summary, the method in accordance with the invention to produce pyrotechnical igniters with an igniting mixture on the basis of metal powders, metal hydrides, potassium perchlorate and binding agents therefore consists of the following method steps:

1. Weighing and filling the components or pre-mixes which are not or only marginally explosive into a mixing or dosing cartridge or metering cartridge;
2. production of the mixture in the cartridge or a small mixing space by application of ultrasonic sound;
3. dosing of the pyrotechnical igniting mixture, unless the mixing has been performed anyway in the receptacle used for the application of the pyrotechnical igniting mixture.

Thereafter the igniting mixtures are relieved of the remaining dispersing agents, which is performed by drying for example, and then supplied to further processing.

A composition of the igniting mixture as illustrated by way of an example is as follows:

55% zirconium powder

43% potassium perchlorate

2% binding agent;

all percentage figures are given in percent by weight.

The ratio of solids to dispersing agent is variable and is usually in the range of 70 to 80% solids.

Titanium or zirconium, or their hydrides respectively, are preferably used as metal. The binding agent is preferably chosen from the group of the fluorinated polymeric aliphatic compounds.

The dispersing agent preferably acts as a solvent for the binding agent and preferably comes from the family of aliphatic ketones. Acetone or methyl ethyl ketone have proven to be suitable for this purpose.

There has thus been shown and described a novel method for producing pyrotechnical igniting mixtures which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A method for producing explosive pyrotechnical igniting mixtures for a pyrotechnical igniting device, said mixtures comprising metal powders and/or metal hydride powders, potassium perchlorate and binding agents, said method comprising the steps of:

a) preparing a plurality of separate, individual suspensions comprising a liquid dispersing agent, a binding agent and at least one of the metal powders, the metal hydride powders and the potassium perchlorate, wherein components of each prepared suspension do not react chemically alone or with each other;

thereby to obtain a plurality of suspensions, each of which is not explosive or no more than marginally explosive;

b) introducing said suspensions into a small mixing chamber while applying ultrasonic sound to the mixing chamber and the suspensions therein, mixing the suspensions homogeneously;

c) dosing the mixed suspensions in a desired quantity immediately after the mixing to produce a pyrotechnic igniting device; and d) removing thereafter the liquid dispersing agent from the dosed, desired quantity of the mixed suspensions.

2. A method as claimed in claim 1 wherein two suspensions are inserted in the mixing chamber, a first suspension comprising at least one of said metal powders and said metal hydride powders, a dispersing agent and a binding agent and a second suspension comprising potassium perchlorate, a dispersing agent and a binding agent.

3. A method a claimed in claim 1, wherein all of said at least one of the metal powders, metal hydride powders and potassium perchlorate have a grain size of <50 $\mu$m.

4. A method a claimed in claim 1, wherein all of said at least one of the metal powders, metal hydride powders and potassium perchlorate have a grain size of <20 $\mu$m.

5. A method as claimed in claim 1, wherein the metal powders are selected from the group consisting of titanium powder and zirconium powder.

6. A method as claimed in claim 5, wherein the metal hydride powders are selected from the group consisting of titanium hydride powder and zirconium hydride powder.

7. A method as claimed in claim 1, wherein the binding agent is selected from fluorinated polymeric aliphatic compounds.

8. A method as claimed in claim 1, wherein the liquid dispersing agent acts as a solvent for the binding agent.

9. A method as claimed in claim 1, wherein the liquid dispersing agent is selected from aliphatic ketones.

10. A method as claimed in claim 1, wherein the liquid dispersing agent is acetone.

11. A method as claimed in claim 9, wherein the liquid dispersing agent is methyl ethyl ketone.

12. A method as claimed in claim 1, further comprising the step of vibrating the suspensions mixed by ultrasonic sound during the dosing step.

13. A method as claimed in claim 12, wherein the suspensions mixed by ultrasonic sound are caused to vibrate during the dosing by introducing sound waves into the suspensions.

14. A method for producing explosive pyrotechnical igniting mixtures for a pyrotechnical igniting device, said mixtures comprising metal powders and/or metal hydride powders, potassium perchlorate and binding agents, said method comprising the steps of:

a) preparing a plurality of separate, individual suspensions comprising a liquid dispersing agent, a binding agent and at least one of the metal powders, the metal hydride powders and the potassium perchlorate, wherein components of each prepared suspension do not react chemically alone or with each other thereby to obtain a plurality of suspensions, each of which is not explosive or no more than marginally explosive;

b) introducing the suspensions in a dosed, desired quantity, for subsequent use of the pyrotechnical igniting mixture, into a housing for a pyrotechnical igniting device, which housing forms a small mixing chamber for the suspensions, while applying ultrasonic sound to the mixing chamber and the suspensions therein, mixing the suspensions homogeneously;

c) removing thereafter the liquid dispersing agent from the dosed quantity of the mixed suspensions.

15. A method as claimed in claim 14, wherein two suspensions are inserted in the mixing chamber, a first suspension comprising at least one of said metal powders and said metal hydride powders, a dispersing agent and a binding agent and a second suspension comprising potassium perchlorate, a dispersing agent and a binding agent.

16. A method a claimed in claim 14, wherein all of said at least one of the metal powders, metal hydride powders and potassium perchlorate have a grain size of <50 $\mu$m.

17. A method a claimed in claim 14, wherein all of said at least one of the metal powders, metal hydride powders and potassium perchlorate have a grain size of <20 $\mu$m.

18. A method as claimed in claims 14, wherein the metal powders are selected from the group consisting of titanium powder and zirconium powder.

19. A method as claimed in claim 18, wherein the metal hydride powders are selected from the group consisting of titanium hydride powder and zirconium hydride powder.

20. A method as claimed in claim 14, wherein the binding agent is selected from fluorinated polymeric aliphatic compounds.

21. A method as claimed in claim 14, wherein the liquid dispersing agent acts as a solvent for the binding agent.

22. A method as claimed in claim 14, wherein the liquid dispersing agent is selected from aliphatic ketones.

23. A method as claimed in claim 14, wherein the dispersing agent is acetone.

24. A method as claimed in claim 22, wherein the liquid dispersing agent is methyl ethyl ketone.

25. A method as claimed in claim 14, further comprising the step of vibrating the suspensions mixed by ultrasonic sound.

26. A method as claimed in claim 25, wherein the suspensions mixed by ultrasonic sound are caused to vibrate by introducing sound waves into the suspensions.

* * * * *